US006505815B1

(12) United States Patent
Dellamore

(10) Patent No.: US 6,505,815 B1
(45) Date of Patent: Jan. 14, 2003

(54) EXTENDABLE BASE AND SUPPORT EXTENSION FOR TRANSPORTABLE LIFT

(75) Inventor: Jean Dellamore, Baltimore, MD (US)

(73) Assignee: Stertil B.V., Koostertille (NL)

( * ) Notice: Subject to any disclaimer, the term of this patent is extended or adjusted under 35 U.S.C. 154(b) by 0 days.

(21) Appl. No.: 09/699,436

(22) Filed: Oct. 31, 2000

(51) Int. Cl.[7] ..... B66F 5/04
(52) U.S. Cl. ..... 254/2 B
(58) Field of Search ..... 254/2 R, 2 B, 254/7 R, 7 B, 134, 100; 269/17, 71, 69

(56) References Cited

U.S. PATENT DOCUMENTS 5,051,056 A * 9/1991 Gibbons et al. ..... 254/7 B
5,338,015 A * 8/1994 Liegel et al. ..... 254/134
5,358,217 A * 10/1994 Dach ..... 254/2 R
5,505,578 A * 4/1996 Fuller ..... 254/2 R
5,911,408 A 6/1999 Berends et al.
5,975,495 A 11/1999 Berends et al.
6,116,577 A * 9/2000 McCanse ..... 254/2 B

* cited by examiner

*Primary Examiner*—Robert C. Watson
(74) *Attorney, Agent, or Firm*—H. Jay Spiegel

(57) ABSTRACT

An extendable base and support extension for a transportable lift making the legs of the base hollow with leg extensions telescopically received within the legs allowing the effective length of each leg of the base to be increased. Removable fork extenders have been provided that may be mounted over the outer surfaces of the forks to extend their effective lengths. The combination of base leg extenders and extensions for the forks provide a transportable lift with the versatility necessary to accommodate to any fender-tire configuration combination. When the legs of the base are extended, the distal ends of the extensions of the legs have wheels mounted in them so that the entirety of the lift is supported on the wheels at the end of the extensions and the wheels behind the stand.

13 Claims, 4 Drawing Sheets

EXTENDABLE BASE AND SUPPORT EXTENSION FOR TRANSPORTABLE LIFT

BACKGROUND OF THE INVENTION

The present invention relates to an extendable base and support extension for transportable lift.

Transportable lifts, per se, are well known. Applicant's Assignee owns U.S. Pat. Nos. 5,911,408 and 5,975,495, both to Berends et al. and each covering aspects of a transportable lift. FIGS. 1–3 depict details of a transportable lift such as is taught in the Berends et al. Patents. With reference to FIGS. 1–3, it is seen that the lift is generally designated by the reference numeral 1 and includes a base 4, a stand 2 and a support 6, movable up and down along the stand 2. The base 4 includes forwardly extending legs 14 and 15, each of which has a wheel 8 at its end remote from the stand 2.

The support 6 consists of forks 16 and 17 which have inclined surfaces 18 and 19, respectively, that are designed to cooperate to engage the undersurfaces of a vehicle tire to facilitate, in conjunction with other transportable lifts operated in tandem, lifting of a vehicle off a ground surface.

As particularly seen in FIG. 1, the transportable lift 1 includes transport wheels 7 as well as a carriage 11 arranged in the stand and provided with guide wheels 12. A cylinder 10 is provided in the stand 2 to facilitate upward movement of the carriage 11. The top of the stand has a cover 3 that closes off that section of the stand 2. A handle 5 is provided for the user which permits steering and dragging the lift during transport. A control 9 is provided which, as is known to those skilled in the art, permits coordination of movements of several transportable lifts arranged with their supports under the respective tires of a vehicle to be lifted.

As the transportable lift 1 is used, it is rolled up to the side of a vehicle adjacent a tire thereof and is rolled forward until the forks 16 and 17 underlie front and rear portions of a vehicle tire. Other transportable lifts are moved, in similar fashion, to positions wherein the forks thereof underlie the other tires of the vehicle. In a coordinated fashion, in a manner well known to those skilled in the art, all of the transportable lifts, for example, four of them, are simultaneously activated to lift the vehicle in a level fashion above the ground surface where the transportable lifts are positioned.

The transportable lift 1 in accordance with the teachings of the prior art operates effectively in situations where the vehicle tires are located with their outer surfaces closely adjacent surfaces of adjacent vehicle fenders. However, where the outer surfaces of vehicle tires are significantly recessed behind vehicle fenders, as shown in FIG. 8, the transportable lift 1 cannot effectively lift the vehicle. This is because before the forks 16 and 17 thereof can engage under the vehicle tires, the stand 2 engages the outer surfaces of the vehicle fender, thereby preventing further forward motion of the base 4. Under such circumstances, it is sometimes possible to move the forks 16 and 17 so that they go partially under the vehicle tires. However, such a scenario presents significant safety concerns, as a risk arises that the vehicle could topple off the lifts, thereby causing injury and possible death.

FIG. 8 schematically depicts the scenario described above. As shown in FIG. 8, the transportable lift 1 has a fork 16 and a stand 2. The fork 16 is seen partially under the tire 20 but the stand 2 is engaging the outer edge of the fender 21, thereby precluding the lift 1 from moving further in the right-hand direction of FIG. 8. In this scenario, it should be clear that the fork 16 is not sufficiently under the tire 20 to facilitate safe lifting.

As such, a need has developed for a transportable lift that can safely lift a vehicle where the outer surfaces of the tires thereof are adjacent the fenders and which also may be used in a scenario such as is depicted in FIG. 8 wherein the tires are significantly recessed behind the fenders. It is with this latter scenario in mind that the present invention was developed.

SUMMARY OF THE INVENTION

The present invention relates to an extendable base and support extension for transportable lift. The present invention includes the following interrelated objects, aspects and features:

1. In a first aspect, many of the features of the transportable lift illustrated in FIGS. 1–3 are included in the present invention including the stand, the support with its forks, and the operating mechanism therefor.

2. A combination of features has been added to the lift illustrated in FIGS. 1–3 to improve upon it and solve the problems set forth in the BACKGROUND OF THE INVENTION hereinabove.

3. A first modification involves the legs of the base. To improve the legs, they have been made hollow with leg extension means comprising leg extensions allowing the effective length of each leg of the base to be increased. In a second aspect, fork extension means comprising removable fork extenders are provided that may be mounted over the outer surfaces of the forks to extend their effective lengths.

4. As should be understood, fork extenders alone will not solve the problems described above because if fork extenders alone were used, the legs of the base would not be sufficiently long enough to prevent the lift from toppling over toward the vehicle that is being lifted. The combination of base leg extensions and fork extenders solves the problems set forth hereinabove and provides a transportable lift with the versatility necessary to accommodate to any fender-tire configuration combination.

5. In accordance with the teachings of the present invention, when the legs of the base are extended, the distal ends of the extensions of the legs have wheels thereon so that the entirety of the lift is supported on the wheels at the end of the extensions and the wheels behind the stand.

As such, it is a first object of the present invention to provide an extendable base and support extension for transportable lift.

It is a further object of the present invention to provide such a device wherein the forks of the support are provided with removable extenders.

It is a still further object of the present invention to provide such a device wherein the legs of the base are extendable through a telescoping mechanism.

It is a yet further object of the present invention to provide such a device wherein the extensions on the base legs have wheels on the ends thereof remote from the stand.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
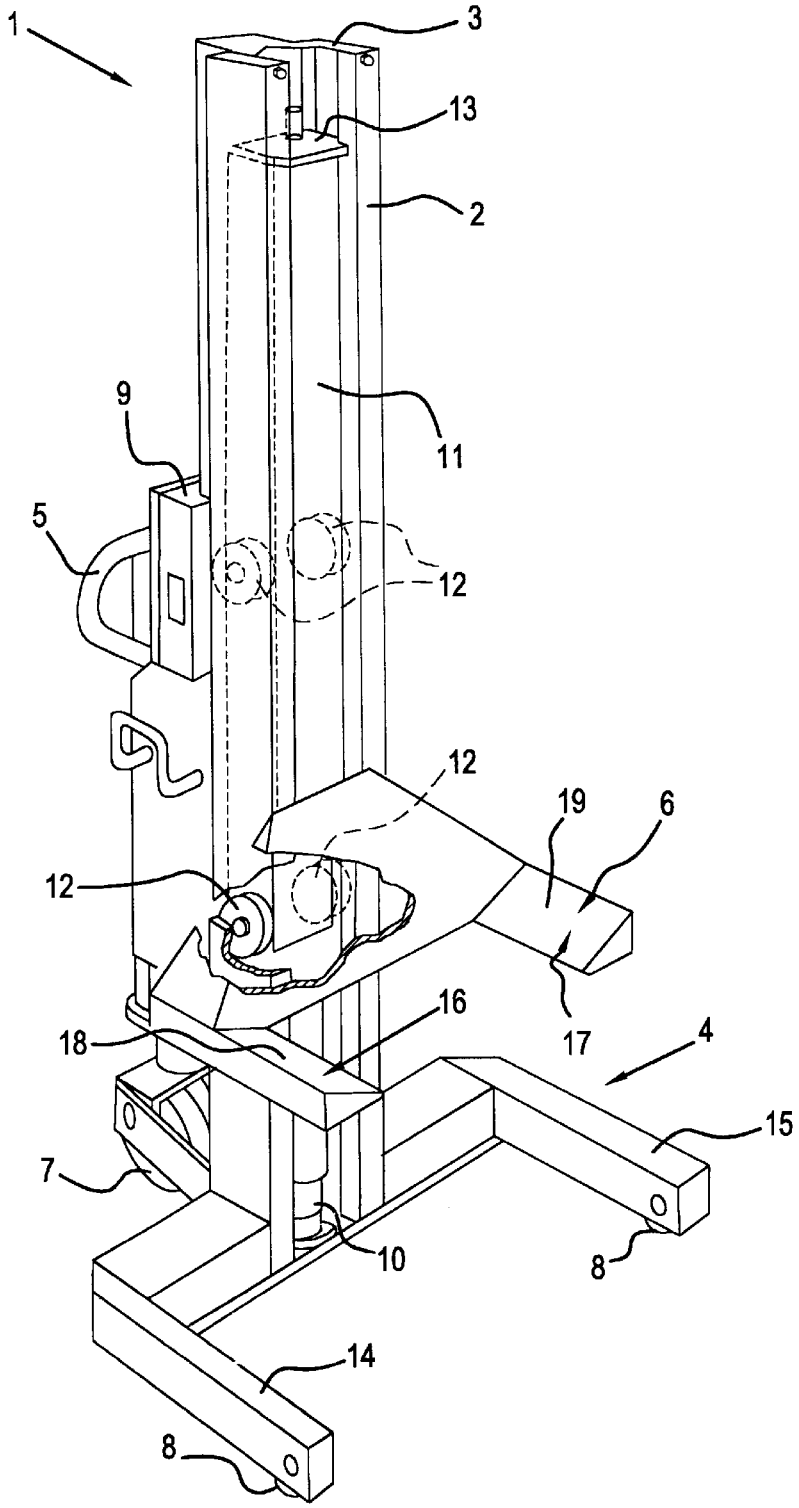
FIG. 1 PRIOR ART
FIG. 1 shows a perspective view of a prior art transportable lift as disclosed in Applicant's Assignee's prior U.S. Pat. Nos. 5,911,408 and 5,975,495.
Figure 2:
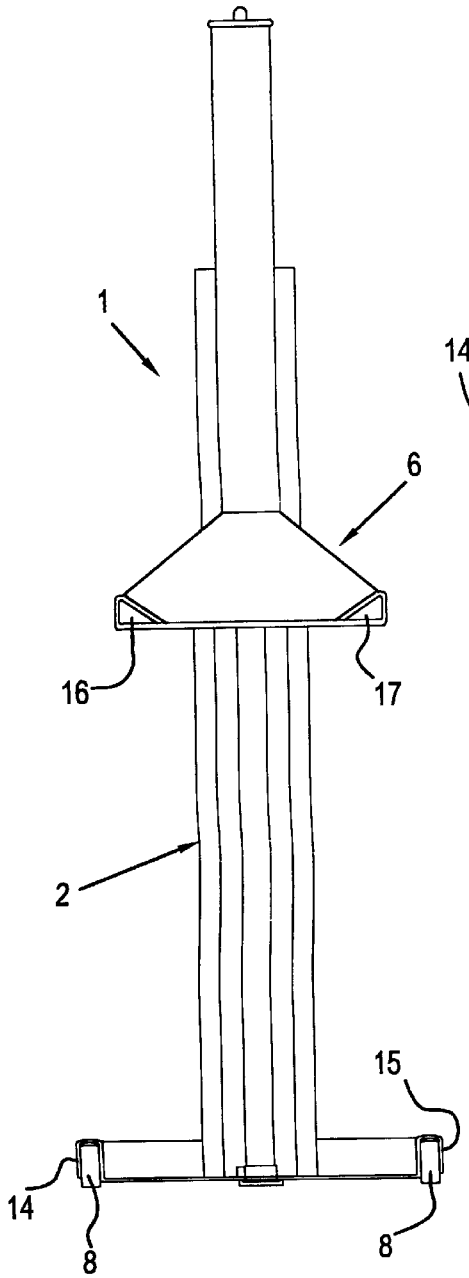
FIG. 2 PRIOR ART
FIG. 2 shows a front view of the prior art lift of FIG. 1.
Figure 3:
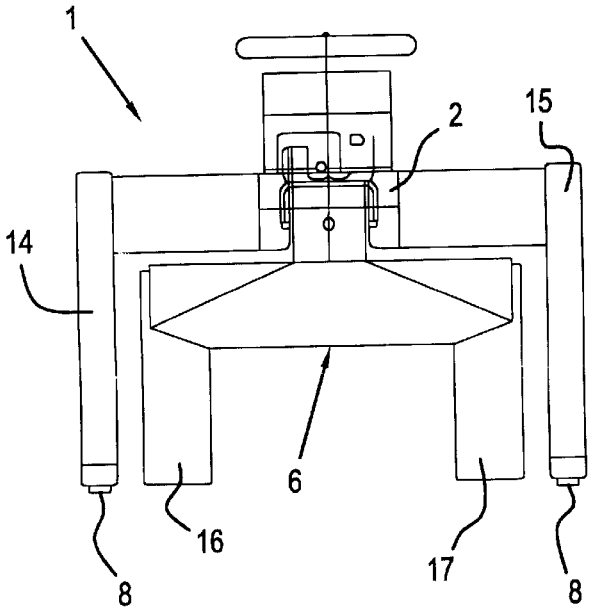
FIG. 3 PRIOR ART
FIG. 3 shows a top view of the prior art lift of FIGS. 1 and 2.

Reference is made to FIGS. 4–7 which depict a transportable lift in accordance with the teachings of the present invention. Some of the features in common between the lift 100 and the lift 1 have been omitted as redundant.

With reference to FIGS. 4–7, it is seen that the lift 100 includes a base 104 and a stand 102. The support 106 includes forks 116 and 117 having the angled surfaces 118 and 119, respectively.

Figure 4:
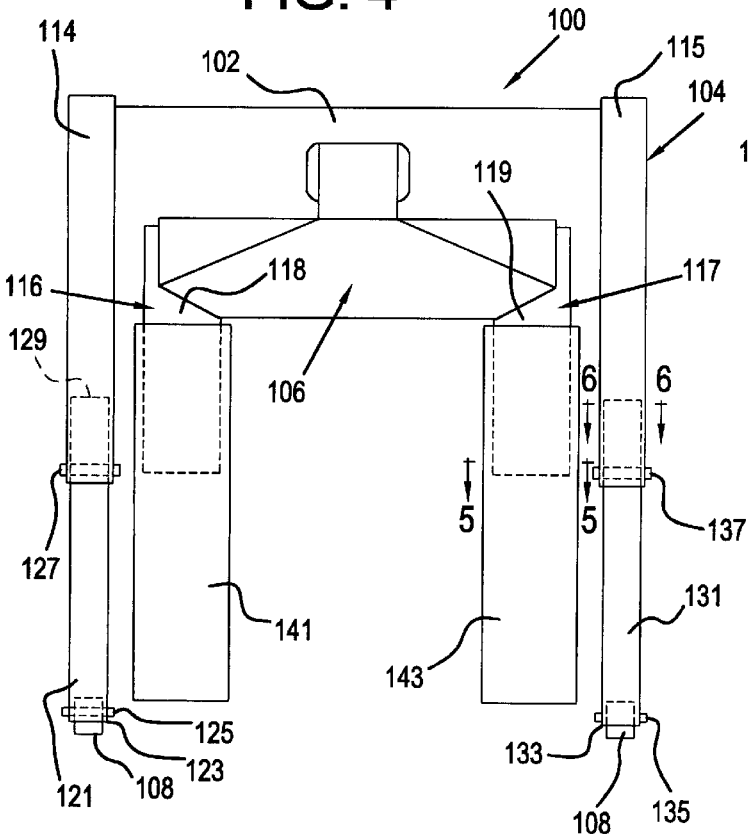
FIG. 4 shows a view similar to that of FIG. 3 but showing the teachings of the present invention with certain portions omitted to accentuate detail.
Figure 6:
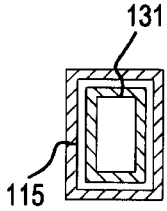
FIG. 6 shows a cross-sectional view along the line 6—6 of FIG. 4.

As seen in FIG. 4, the leg 114 has a leg extension or extendable portion 121 that, when used, has the wheel 108 on its distal end 123 secured thereto by a pin 125, but also forms the axle for the wheel 108. A further pin 127 secures the proximal end 129 of the extendable portion 121 in place with respect to the leg 114. Similarly, the leg 115 has an extendable portion 131 having the wheel 108 secured at its distal end 133 by the pin 135 that also serves as the axle for the wheel 108. A further pin 137 secures the extendable portion 131 with respect to the leg 115. The telescoping nature of the portion 131 with respect to the leg 115 is seen in FIG. 6.

In operation, when the extendable portions 121 and 131 are not to be used, they are retracted within the legs 114 and 115, respectively. When so retracted, the pins 127 and 137 may be removed and the pins 125 and 135 may be located in place of the pins 127 and 137 serving the functions of retaining the extendable portions 121 and 131 in the retracted position and also serving as the axles for the respective wheels 108.

Figure 5:
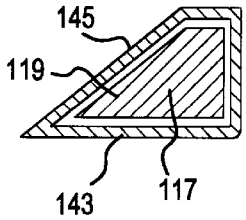
FIG. 5 shows a cross-sectional view along the line 5—5 of FIG. 4.

With further reference to FIGS. 4 and 5, it is seen that fork extenders 141 and 143 are provided for the respective forks 116 and 117. As should be understood from FIG. 5, the extender 143 includes the surface 145 which is parallel to the surface 119 formed on the fork 117. The extender 141 is symmetric to the extender 143 in the same manner that the fork 116 is symmetric to the fork 117.

As should be understood from FIG. 4, when the extenders 141 and 143 are installed by sliding them over the forks 116 and 117, respectively, the effective length of the forks 116 and 117 is extended to a distance approximating the distance of extension of the base legs 114 and 115 when the extendable portions 121 and 131, respectively, are extended as shown in FIG. 4.

Figure 7:
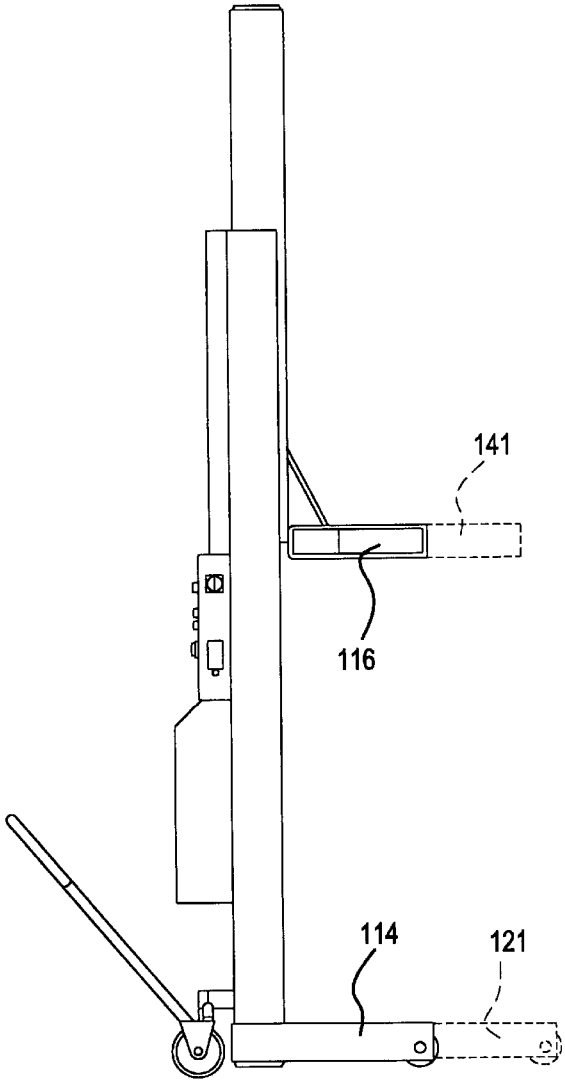
FIG. 7 shows a side view of the lift in accordance with the teachings of the present invention.
Figure 8:
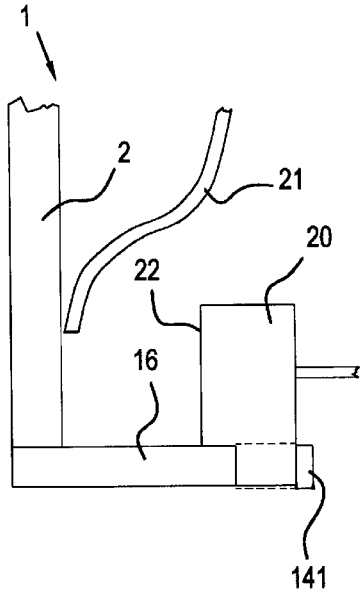
FIG. 8 shows a representation of a vehicle tire with a fender significantly spaced from the outer surfaces of the tire.

In the scenario shown in FIG. 4, one can see in FIG. 7 the extension of the legs and the forks. The phantom lines depicted by the reference numeral 141 in FIG. 8 shows schematically the extension of the forks that enables the inventive device 100 to lift a vehicle (not shown) despite the significant spacing from the outer surface 22 of the tire 20 and the surfaces of the fender 21.

As explained above, were the invention to merely consist of the fork extenders 141 and 143, and not include the extendable portions 121 and 131 of the legs 114 and 115, respectively, when upward force is applied to the support 106, the lift would topple in the clockwise direction of FIG. 7 since the base 104 would not extend outwardly a significant enough distance to adequately support the load being imposed on the device 100. Thus, the present invention contemplates the combination of the extenders 141 and 143 as well as the extendable portions 121 and 131.

As should be understood, due to the heavy loads contemplated, the lift 100 is made of materials corresponding to those from which the lift 1 is made. The extendable portions 121 and 131 as well as the fork extensions 141 and 143 are made of similar strong materials such as, for example, hardened steel, in anticipation of the loads to be imposed thereon.

As such, an invention has been disclosed in terms of a preferred embodiment thereof which fulfills each and every one of the objects of the invention as set forth hereinabove and provides a new and useful extendable base and support extension for transportable lift of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. In a transportable lift having a base with two forwardly extending legs, a stand upwardly extending from said base and a support reciprocable on said stand, said support having spaced forks adapted to underlie surfaces of a vehicle tire to facilitate lifting of said vehicle, said forks being non-rotatable with respect to said stand and base, the improvement comprising:

a) leg extension means for selectively extending overall length of said legs; and b) fork extension means for selectively extending overall length of said forks, said fork extension means comprising a fork extender mounted over each fork and extending beyond an extent of a fork over which said fork extender is mounted, each fork extender having a sloping surface configured to underlie a vehicle tire.

2. The lift of claim 1, wherein said leg extension means comprises:

a) said legs being hollow; and b) a leg extension telescopically received within each leg.

3. The lift of claim 2, further including a rotatable wheel at an end of each leg extension remote from said stand.

4. The lift of claim 2, further including a locking pin insertable between each said leg and leg extension to lock said leg and leg extension together.

5. The lift of claim 4, wherein said pin is lockable between said leg and leg extension in a retracted position of said leg extension and in an extended position of said leg extension.

6. The lift of claim 4, further including a rotatable wheel at an end of each leg extension remote from said stand.

7. The lift of claim 6, wherein said pin comprises an axle supporting said wheel.

8. The lift of claim 1, wherein each fork extender includes a hollow interior sized to slidably receive a fork therewithin.

9. A transportable lift having a base with two forwardly extending legs, a stand upwardly extending from said base and a support reciprocable on said stand, said support having spaced forks adapted to underlie surfaces of a vehicle tire to facilitate lifting of said vehicle, said forks being non-rotatable with respect to said stand and base, said lift further including:

a) telescoping leg extension means for selectively extending overall length of said legs; and b) fork extension means overlying said forks for selectively extending overall length of said forks, said fork extension means comprising a fork extender mounted over each fork and extending beyond an extent of a fork over which said fork extender is mounted, each fork extender having a sloping surface configured to underlie a vehicle tire;

c) said legs being hollow; and d) a leg extension being telescopically received within each leg.

10. The lift of claim 9, further including a rotatable wheel at an end of each leg extension remote from said stand.

11. The lift of claim 10, further including a locking pin insertable between each said leg and leg extension to lock said leg and leg extension together, said pin also comprising an axle of said wheel.

12. The lift of claim 11, wherein said pin is lockable between said leg and leg extension in a retracted position of said leg extension and in an extended position of said leg extension.

13. The lift of claims 9, wherein each fork extender includes a hollow interior sized to slidably receive a fork therewithin.

* * * * *